US010376802B2

(12) United States Patent
Atalla

(10) Patent No.: US 10,376,802 B2
(45) Date of Patent: Aug. 13, 2019

(54) SINKABLE TOY WARSHIPS

(71) Applicant: Bonis Opus LLC, Harrington Park, NJ (US)

(72) Inventor: Elie Atalla, Harrington Park, NJ (US)

( * ) Notice: Subject to any disclaimer, the term of this patent is extended or adjusted under 35 U.S.C. 154(b) by 7 days.

(21) Appl. No.: 15/794,285

(22) Filed: Oct. 26, 2017

(65) Prior Publication Data

US 2018/0345159 A1 Dec. 6, 2018

Related U.S. Application Data

(60) Provisional application No. 62/513,326, filed on May 31, 2017.

(51) Int. Cl.

| | |
|---|---|
| ***A63H 23/02*** | (2006.01) |
| ***A63H 30/04*** | (2006.01) |
| ***A63H 23/06*** | (2006.01) |
| *A63H 23/12* | (2006.01) |

(52) U.S. Cl.

CPC ..... *A63H 23/06* (2013.01); *A63H 23/12* (2013.01)

(58) Field of Classification Search

None

See application file for complete search history.

(56) References Cited

U.S. PATENT DOCUMENTS 1,205,759 A * 11/1916 Lewis ..... A63H 23/02 446/161
1,264,965 A * 5/1918 Noah ..... B63G 8/001 114/312
2,903,822 A * 9/1959 Reid ..... A63H 23/04 114/144 R
2,968,120 A * 1/1961 Reed ..... A63H 23/10 239/17
3,451,159 A * 6/1969 Springfors ..... A63H 23/02 446/161
3,721,038 A * 3/1973 Viczena ..... A63H 23/02 446/160
3,889,623 A * 6/1975 Arnold ..... B63H 11/08 440/39
4,077,629 A * 3/1978 Chestney ..... A63B 67/007 273/349

(Continued)

FOREIGN PATENT DOCUMENTS

CN 201445778 U * 5/2010
CN 201482201 U * 5/2010

(Continued)

OTHER PUBLICATIONS

English translation of IT 1129857 B provided by Steven Spar.*

(Continued)

*Primary Examiner* — John E Simms, Jr.
*Assistant Examiner* — Urszula M Cegielnik
(74) *Attorney, Agent, or Firm* — Heed Law Group PLLC; Thomas P. Heed

(57) ABSTRACT

The invention is Sinkable Toy Warships, in particular, remotely controlled toy boats that can shoot water, be shot at by other boats, retain water that hits them directly, continue to be operational after being hit, sink when a predetermined volume of water has been absorbed, remain near the surface where it can be located and can be recovered after being submerged with no ill-effects to the electric and electronic components on board.

7 Claims, 5 Drawing Sheets

(56) References Cited

U.S. PATENT DOCUMENTS 4,171,675 A * 10/1979 Thompson ..... B63H 1/04 114/58
4,292,758 A * 10/1981 Kuna ..... A63H 33/28 446/163
4,938,483 A * 7/1990 Yavetz ..... A63H 30/04 273/454
5,203,729 A * 4/1993 Beller ..... B60F 3/0023 440/113
5,295,890 A * 3/1994 Myers ..... A63H 17/006 446/155
6,022,261 A * 2/2000 Zhu ..... A63H 23/02 446/161
7,255,054 B1 * 8/2007 DiGregorio ..... B63G 8/001 114/256
7,472,508 B2 * 1/2009 Myers, IV ..... A01M 31/06 43/26.1
2003/0073375 A1 * 4/2003 Lee ..... A63H 23/04 446/153
2004/0002282 A1 * 1/2004 Lee ..... A63H 23/04 446/158
2004/0077263 A1 * 4/2004 Lee ..... A63H 23/04 446/163
2004/0082268 A1 * 4/2004 Choi ..... A63H 17/004 446/454
2005/0045408 A1 * 3/2005 Lee ..... A63H 23/04 180/312
2005/0208867 A1 * 9/2005 Higashida ..... A63H 23/04 446/154
2005/0268834 A1 * 12/2005 Koda ..... A63H 23/04 114/144 RE
2008/0057822 A1 * 3/2008 Curtis ..... A63H 23/08 446/153
2009/0064915 A1 * 3/2009 Passoni ..... B63B 35/665 114/343
2009/0081920 A1 * 3/2009 Strebeigh ..... A63H 23/02 446/160
2012/0141205 A1 * 6/2012 Gordon ..... B63B 35/00 405/27
2015/0224413 A1 * 8/2015 Mimlitch, III ..... G01R 27/02 446/158
2016/0256792 A1 * 9/2016 Mowbray ..... A63H 23/04

FOREIGN PATENT DOCUMENTS

CN 201840885 U * 5/2011
GB 2023435 A * 1/1980
IT 1129857 B * 6/1986

OTHER PUBLICATIONS

CN201445778U_MT: English Machine Translation of CN 201445778 U.*
CN201482201U_MT: English Machine Translation of CN 201482201 U.*
CN201840885U_MT: English Machine Translation of CN 201840885 U.*

* cited by examiner

SINKABLE TOY WARSHIPS

CROSS-REFERENCE TO RELATED APPLICATION

This application claims priority to U.S. Provisional Application No. 62/513,326, filed May 31, 2017, which is incorporated by reference in its entirety.

BACKGROUND

The present disclosure relates to Sinkable Toy Warships, in particular, remotely controlled toy boats that can shoot water, be shot at by other boats, retain water that hits them directly, sink when a predetermined volume of water has been absorbed and can be recovered after being submerged with no ill-effects to the electric and electronic components on board.

Kids and adults have long played with remotely controlled vehicles but, beyond racing against one another, there are very few games that can be played between opponents. In addition, racing of vehicles requires a great deal of space, it is usually restricted to outdoor play and requires a race course with boundaries, buoys and a finish line. Due to these factors and because available vehicles vary in size, speed and maneuverability, the competition is usually unequal and unfair.

Another problem exists where vehicles are supposed to shoot at each other. For this to be truly realistic the losing player's vehicle would need to be visibly damaged or disabled by the winning player's accurate shooting. This of course does not happen because it would mean damaging a child's toy. In addition, when toys are designed to shoot projectiles they become a danger to young players who may accidentally be hit in the eye or face.

SUMMARY

The following presents a simplified summary of one embodiment of the invention in order to provide a basic understanding of the invention. This summary is not an extensive overview of the invention. It is not intended to identify key/critical elements of the invention or to delineate the scope of the invention. Its sole purpose is to present an embodiment of the invention in a simplified form as a prelude to the more detailed description that is presented later.

The invention provides a new way to play and compete with remote-controlled toys. The boats are able to shoot water which is a harmless projectile, but, when used on the invention, it still has a very real and noticeable effect on the opponent's boat. As the boat takes on water it will slowly lose speed and maneuverability and eventually sink below the surface, at which point a clear victor can be declared. The invention is designed to withstand full submersion and so it can be removed from the water, emptied and is immediately ready to be played with again.

This new game with remote controlled boats requires much less space than a racing competition and the invention can be miniaturized enough to be played with in a very small pool indoors or out. At the same time, the toy can be played with in a full-size pool, a pond or any other body of water. This is especially true when a floatation device is built onto the deck of the ship so that it can sink below the surface but will not sink all the way to the bottom. This makes it easy to locate and recover.

The invention can be customized so that the boats have a variety of water cannons to choose from and varying capacities for taking on water and varying speed and maneuverability. However, these factors can be balanced so that boats of equal strength can be matched with one another, leaving only the players' skill and strategy as determinants of victory.

The invention differs from what currently exists. It is unique and novel because it allows players to shoot real projectiles in the form of water which is harmless to a player but will inflict real and incremental damage to other boats. This is because these boats are specifically designed to take on water through their deck, retain water in their hull until they are too heavy to float, and continue to operate until their maximum water capacity is reached. In addition, other boats that are water-resistant are only that, water-resistant, but not watertight. And, if they are watertight, they are designed to stay afloat and not sink. In addition, the invention can be built to sink just enough to become incapacitated and clearly defeated, but buoyant enough to stay near the surface where it can be located and recovered. Combining these characteristics with the ability to pull water from below their hull and propel it at their opponents makes the invention a unique toy and provides a completely new way of playing with remote control vehicles.

Sinkable Toy Warships are comprised of a stable hull with high walls, a pump that is attached to an intake hole below the waterline on one end and one or more water cannons on the other end, a power source, a remote-control receiver and controller and one or more motors with propellers. On the surface or deck of the ship there are several holes through which water can enter into the hull, while (optionally) the structures on the boat deck can be made hollow to provide floatation and prevent the boat from sinking completely to the bottom of the body of water in which it is being played with. Inside the hull, all electric components are enclosed in waterproof compartments and wires are made to run through specially designed channels which are sealed from both ends.

A remote control with a matching frequency would accompany the toy and would have at least 3 functions, including forward propulsion, shooting the cannon and steering, however, in a preferred embodiment the boat would have 5 or more functions, including forward and reverse for two different motors (which also provides for steering), plus a shooting function.

In one aspect, the present invention provides a toy ship comprising: a hull comprising a floor and a plurality of walls extending upwardly therefrom, a space formed between the floor and walls; a deck extending between the plurality of walls above the floor; at least one void extending through the deck and into the space; at least one deck structure extending upwardly from the deck, the at least one deck structure being enclosed and substantially hollow therein; a power source housed within the space; a pump housed within the space and powered by the power source, the pump having an inlet and an outlet, the inlet extending through the hull and exposed outside the hull opposite the space, the outlet extending upwardly through the deck and operably coupled to an output device; a driving mechanism fixed to the hull and powered by the power source; and a receiver housed within the space and operably coupled to the pump and driving mechanism, the receiver configured to receive signals remotely for controlling the pump and driving mechanism.

In another aspect, the present invention provides a toy ship comprising: a hull comprising a floor and a plurality of walls extending upwardly therefrom, a space formed between the floor and walls, the hull being substantially sealed; a deck extending between the plurality of walls above the floor; at least one void extending through the deck and into the space, the at least one void configured to receive liquid collectible within the space; at least one deck structure extending upwardly from the deck, the at least one deck structure being enclosed and substantially hollow therein; a power source; a driving mechanism powered by the power source; an output device operably coupled to the driving mechanism; and a receiver operably coupled to the driving mechanism, the receiver configured to receive signals remotely for controlling the driving mechanism.

In yet another aspect, the present invention provides a toy ship comprising: a hull comprising a floor and a plurality of walls extending upwardly therefrom; a deck extending between the plurality of walls above the floor; a space formed between the deck and floor; at least one void extending through the deck and into the space; at least one deck structure extending upwardly from the deck, the at least one deck structure being enclosed and substantially hollow therein; a power source; at least one driving mechanism powered by the power source; an output device operably coupled to the at least one driving mechanism; and a receiver operably coupled to the at least one driving mechanism and configured to receive signals remotely for controlling the at least one driving mechanism.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
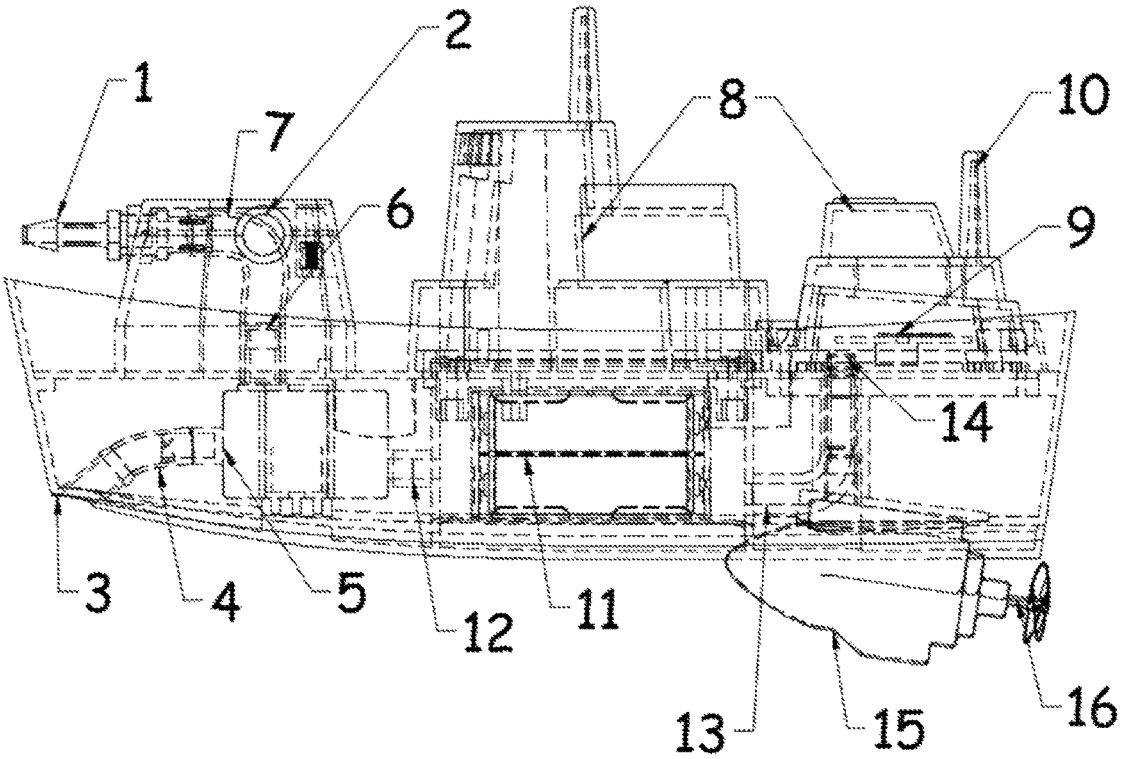
FIG. 1 shows the invention from a side view with the internal arrangement of components visible and depicted as dotted lines.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Referring to the figures, embodiments of the toy ship of the present invention are shown. The toy ship of the present invention will also be referred to as "Sinkable Toy Warship" throughout the specification.

Figure 2:
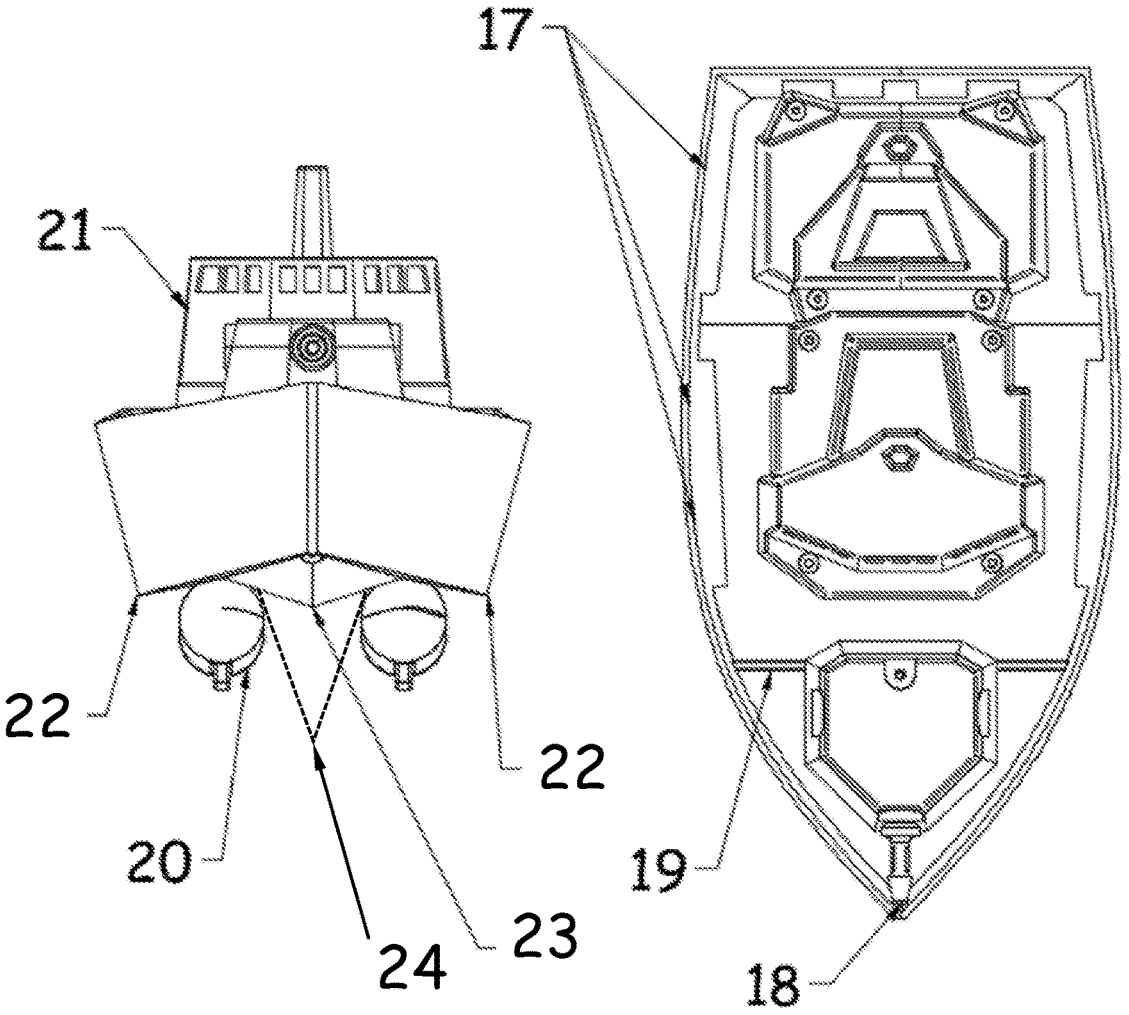
FIG. 2 shows the invention from the front (left) and top (right).

As shown in FIG. 1, the invention is made with a stable, wide hull that will maintain a generally upright position when turning and when water accumulates in its body. FIG. 2 (left side), shows a front view with the hull having two chines, 22, running along the sides of the hull and deepest in the rear of the boat for stability, and a deeper V-shaped middle, 23, that runs the entire length of the hull. For deeper water and additional stability in rough water, a modified keel, 24, shown in dotted lines, runs the length of the boat but is deepest near the middle. The keel, 24, is modified to be hollow and wider so that it can collect water that enters from above and provides the boat with ballast and stability even while it is slowly being sunk by an opponent.

FIG. 1, shows the shooting mechanism which starts at an inlet or intake, 3, moves through a hose, 4, into a driving mechanism or a pump, 5, and up through the nozzle, 6, into a conduit or gun tube, 7, and out of an output device or cannon, 1, through a cannon end, 18, as shown in FIG. 2. Importantly, the intake, 3, will provide a counter-balancing force when made to face the same direction as the cannon, 1. In the figure it is shown to be pulling water in from the front which pulls the boat forward, while the cannon, 1, pushes water out of the front, which pushes the boat backwards. The net result is a muted effect on the boat's position during the cannon's operation.

Figure 5:
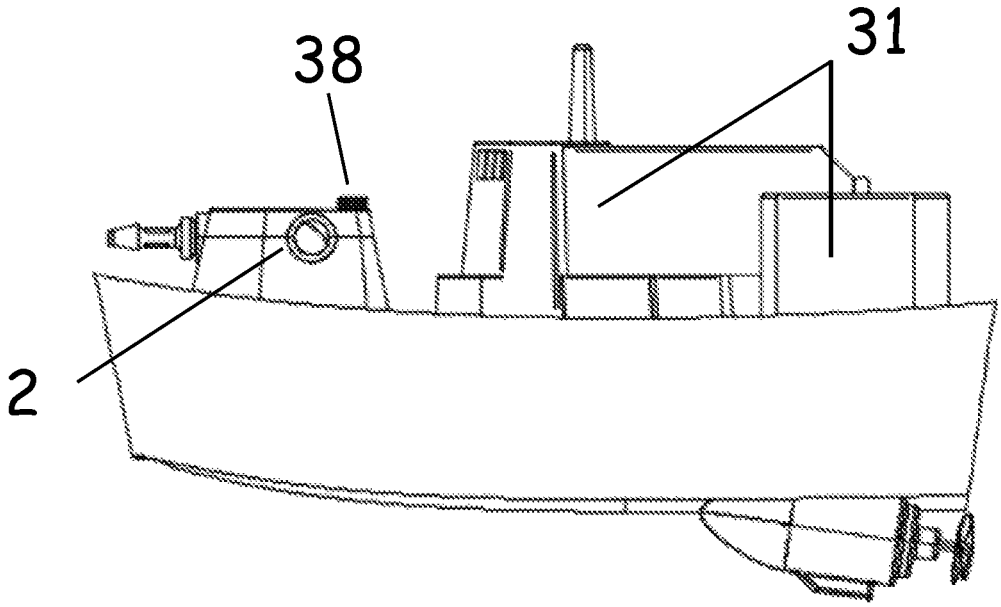
FIG. 5 shows a typical version of the invention when the deck is adorned with extra-large, hollow structures which provide buoyancy after the boat's hull has sunk below the surface.
Figure 6:
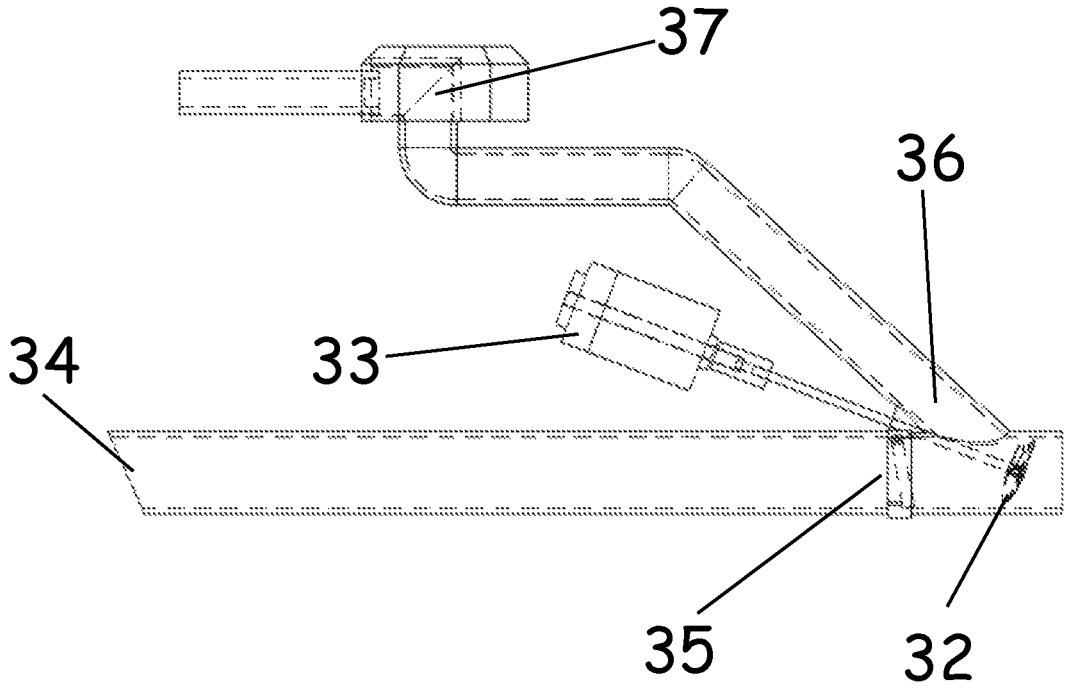
FIG. 6 shows an alternate embodiment of the motor, propeller and water cannon, where an internal propeller (impeller) is installed inside a water channel, which is below the boat and connected to a turbo drive as well as a water cannon.

A gun turret, 37, shown in FIG. 6, can also be used to hold additional or alternate guns pointing in other directions, such as towards the starboard and the port sides simultaneously. FIG. 5, item 2, shows the positioning hole for such an alternative arrangement for the guns. In addition, to allow the player to quickly change the gun during play, the turret top can be made to be removable after unscrewing a thumbscrew, 38, and exposing the connection with the gun hose, 7.

Referring to FIGS. 1 and 2, the boat includes one or more driving mechanisms or motors, 15, which may be electric or fuel powered, and which are housed within a motor housing, 20. In FIG. 1, item 16, two output devices or propellers are shown installed slightly below the hull bottom. This arrangement provides extra maneuverability because the propellers are more effective for reversing direction when the water flow from the front to the back is unobstructed (or at least less obstructed) by the boat hull itself. This is especially important to the Sinkable Toy Warship because reverse is used often when in battle, and, it should not result in backsplash that runs up and over the back of the hull.

Batteries, 11, may be used as a power source and should be mounted near the middle of the boat due to their weight. Alternatively, the boat may be solar or gas powered.

In a watertight compartment, a receiver and controller on a circuit board, 9, would be safely mounted and wired to an antenna, 10, the motor(s), 15, the pump, 5, and optionally a rudder. The remote-control receiver must be set to the same frequency as the remote controller and should have additional channels for each action, including the firing of the gun or guns.

Wiring is made waterproof by protecting the connections within the watertight compartment, 8, and, the watertight compartments themselves are protected from leaks through the use of wire conduits, 12, 13 and 14, which provide an entry way for wires and an extended channel into which waterproofing material, such as silicone or adhesives, can be injected. The silicone can then envelope the wires within the wire conduits while providing a seal at both ends. For additional protection, the pump, which is itself waterproof and submersible, can have its wiring run into the battery compartment through one conduit, 12, and then out through another conduit, 13, before finally entering the waterproof compartment and connecting to the circuit board, 9. Effectively, this design prevents water from entering the waterproof compartment as it requires water collected in the hull of the boat to go through the two conduits and the battery compartment before it can enter the circuit board compartment.

Figure 3:
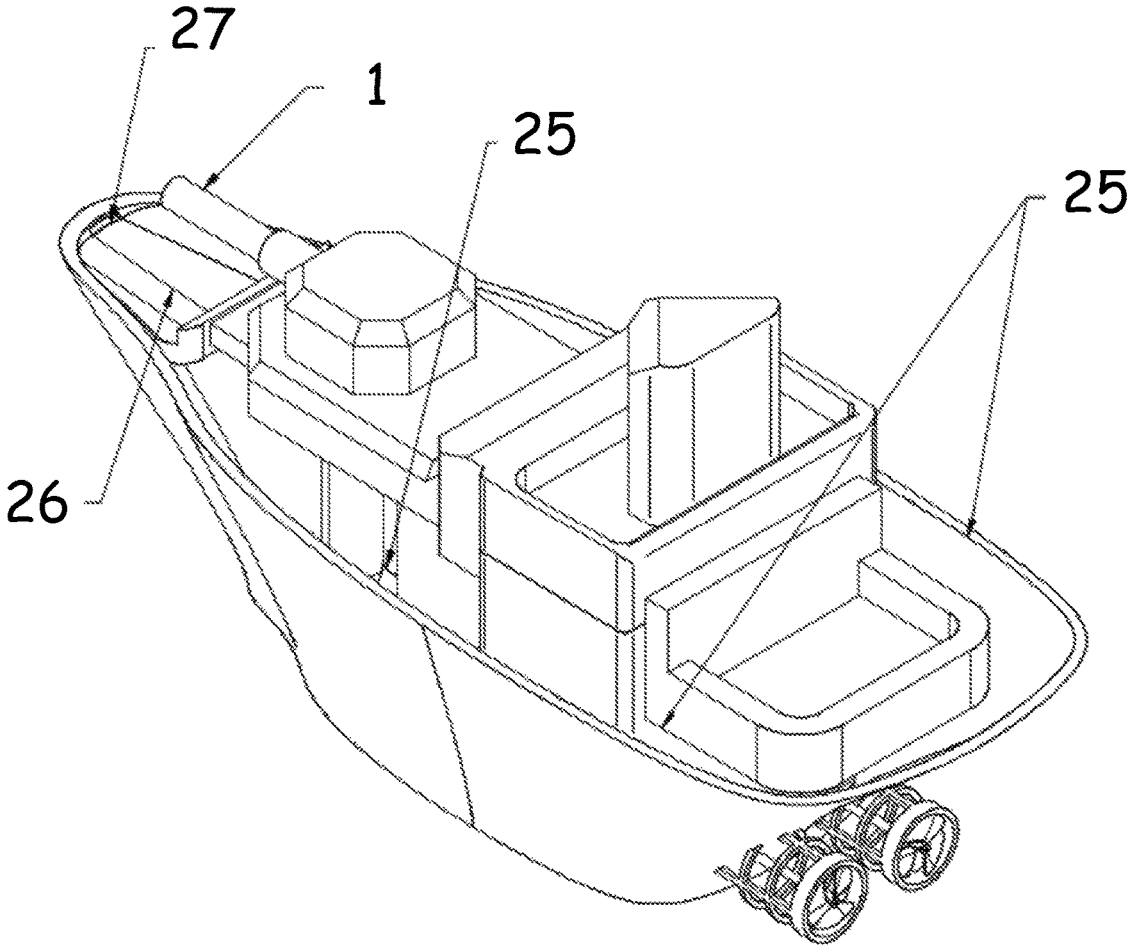
FIG. 3 is a perspective view from the right, left and shows an alternative, larger embodiment of the invention meant for deeper water and mimicking the shape of a battleship.

Sinkable Toy Warships are designed to absorb water rather than repel it and therefore will have multiple entry points, 25, on the deck, 17, through which water will drain into the hull, as shown for example in FIG. 2. In larger boats, as shown in FIG. 3, or other small embodiments, the majority of the deck can simply be omitted, thus providing water ample room to enter the hull, as shown for example in FIG. 3. That is, voids, 25, are provided on the deck, 17, so that water can enter the hull and accumulate therein.

When necessary, a gun bib, FIG. 3, 26, can be installed below active guns, 1, that may dribble into their own hulls. Such a gun bib would include a retaining wall, FIG. 2, 19, to keep the water from rolling back into the hull, a sloped surface, and a drainage hole, 27.

Figure 4:
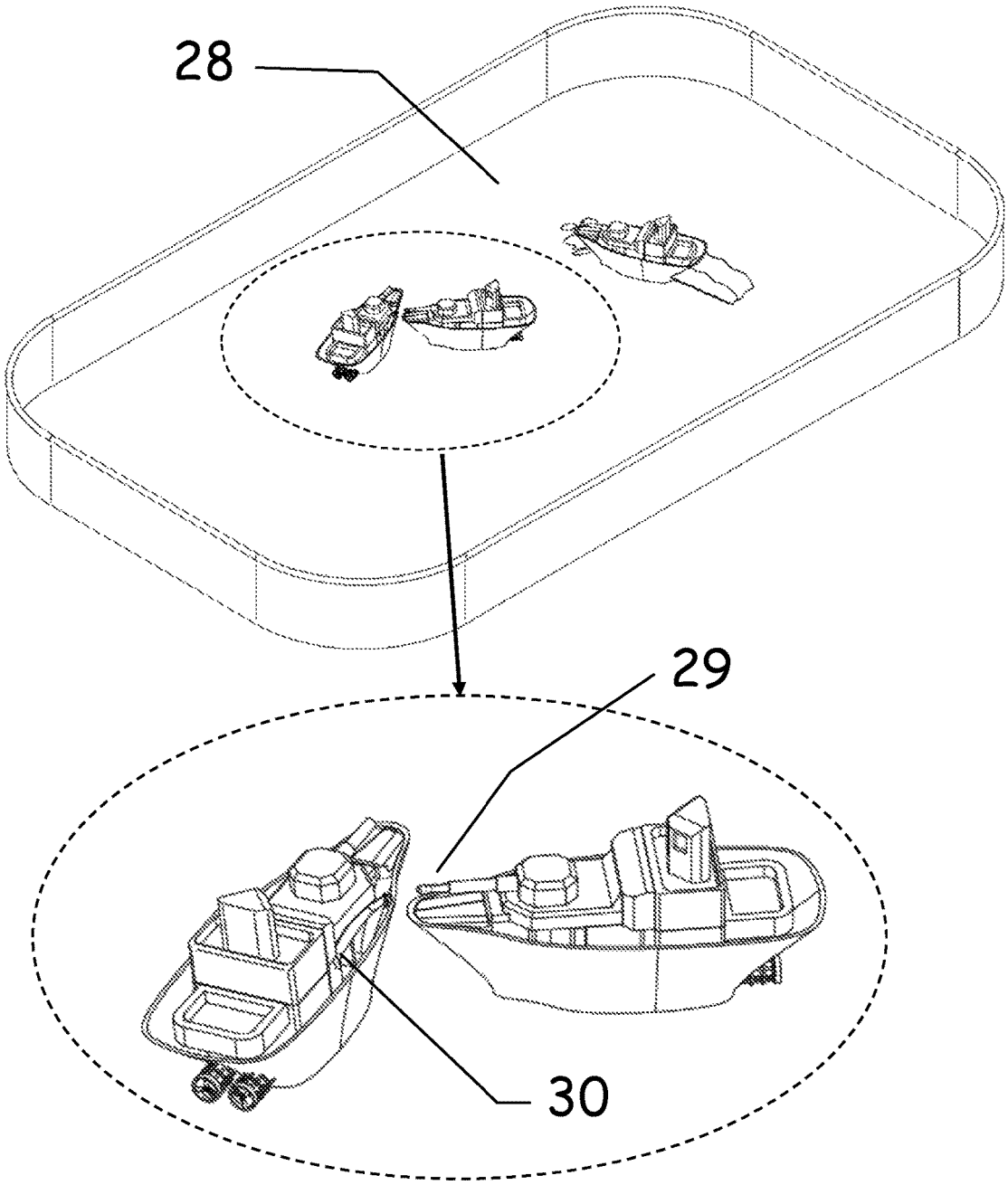
FIG. 4 shows three different units of the invention in the midst of battle and doing so in a small pool that may be used indoors on a tabletop or garage floor. The expanded view provides a closeup of a shooting boat and a sinking boat.

During play, boats of equal strength can battle each other in small, indoor pools, FIG. 4, 28. Such pools can be made small enough to be placed on a tabletop or floor, and the guns can be mounted so that water shot from the guns, 29, are restricted to lateral or downward movement such that it cannot be shot outside of the playing arena. Furthermore, the guns, 29, will not work once the boat is removed from the pool because the pool is in fact their only source of water or "ammunition". The pump, 5, can still be activated but no water can be pushed out through the gun, 29. The result is that boats will move about and shoot at their opponents and the water will only be able to hit a target, 30, and sink their opponents as intended.

Also, the players could determine that a particular ship has lost when the entire hull is submerged, i.e., when ship is still floating but the deck, 17, is under water. In the alternative, a pressure sensor or moisture sensor could be operably coupled to the circuitry so that when water is detected at the top of the deck or higher pressure is detected at the bottom of the deck the sensor could sound an alarm and/or disable the power source and/or the receiver such that the ship is deactivated.

The invention can be played with on any body of water, including small pools, large pools, ponds, lakes and salt water. When it is intended for play in deep water the invention will be made to include built in deck structures or floatation devices in the form of extra-large, watertight voids, FIG. 5, items 31, and FIG. 2, item 21, which would require displacement that is greater in weight than that of the boat and its components. By mounting these floatation cavities, 31, on the deck, much of the boat is still allowed to sink below the surface and become incapacitated but the topside buoyancy will ensure that it will still be near the surface where it can be located and recovered.

Larger environments are ideal for team play, where a team may be equipped with a fleet of boats with varying specialties, such as a battleship with strong guns and a deep hull but weak speed and maneuverability, and a destroyer with weak guns and a smaller hull but strong speed and maneuverability. Obstacles can be added to challenge the boat operators and provide areas with cover from fire. And targets can be used as the objective. For example, a large, defenseless boat may be the target of each team and must be protected from enemy fire. Sinking the target can be used as the final indicator of team victory.

In an alternate embodiment shown in FIG. 6, the motor, 33, can be used in a jet propulsion channel, 34, to drive an impeller, 32, which pulls water through the channel and out the back of the boat for forward movement. In this alternate arrangement the motor, 33, can be put into reverse and thus act as an axial pump which now pulls water in from the rear of the boat, against a check valve, 35, which automatically closes, driving water up through the gun tube, 36 and out through the turret, 37. The benefit of such an arrangement is two-fold, first it eliminates the need for a pump and the third motor within it, and second, it eliminates the need for a separate remote-control function for reversing and shooting because when the motor is reversed it will in fact result in both actions: the gun shoots water forward, and in so doing, it also pushes the boat back. That reactive force is magnified by the water being pulled in from the back of the boat, resulting in an even stronger reversing effect.

In other alternate embodiment, the gun can be fired through the use of a diaphragm pump that provides intermittent fire. Similarly, a pulsating pump can be used to make the weapon act like a machine gun. If large shots are preferred, for example for a large battleship, a reservoir or bladder can be filled by a pump or gravity and, once it is full and therefore "armed", the bladder can be rapidly pressurized by a spring mechanism or actuator pressing up against its sides, thus forcing the water out of the weapon it is connected to. Such weapons would have faster, larger "bullets" but would not be continuous.

Optionally, the Sinkable Toy Warship may have built-in pressure or moisture sensors in their hulls which can be used to sound an alarm when a boat is in danger of sinking. Sound effects can also be triggered when the gun is fired to enhance the experience and illusion of a real battle.

The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

I claim:

1. A toy ship comprising a hull comprising a floor and a plurality of walls extending upwardly therefrom, the hull being substantially sealed;

a deck having an upper surface and a lower surface, the upper surface being exposed to the outside, the deck extending between the plurality of walls above the floor;

a space formed between the floor, the walls, and the lower surface of the deck;

at least one void extending through the deck from the upper surface of the deck, through the lower surface of the deck, into the space, the at least one void configured to receive liquid, collectible within the space during play;

at least one deck structure extending upwardly from the upper surface of the deck, the at least one deck structure being enclosed and substantially hollow therein;

a power source housed within the space;

a pump housed within the space and powered by the power source, the pump having an inlet and outlet, the inlet extending through the hull and exposed outside the hull opposite the space, the outlet extending upwardly through the deck and operably coupled to an output device;

a driving mechanism fixed to the hull and powered by the power source; and a receiver housed within the space and operably coupled to the pump and driving mechanism, the receiver configured to receive signals remotely for controlling the pump and driving mechanism;

wherein, during play, the liquid collected in the space may at least partially submerge the toy ship, rendering it at least partially incapacitated.

2. The toy ship of claim 1, wherein the at least one deck structure provides sufficient buoyancy such that the toy ship is not completely submergible when the space is filled with liquid, although it is rendered incapacitated.

3. The toy ship of claim 1, further comprising a sensor operably coupled to the power source.

4. The toy ship of claim 3, wherein the sensor is positioned on a bottom surface of the deck such that the power source is deactivated when a predetermined pressure is detected by the sensor.

5. The toy ship of claim 3, wherein the sensor is positioned on a top surface of the deck such that the power source is deactivated when a predetermined amount of liquid is detected by the sensor.

6. The toy ship of claim 1, wherein the output device is operably coupled with the receiver and remotely controlled.

7. A toy ship comprising:

a hull comprising a floor and a plurality of walls extending upwardly therefrom;

a deck having an upper surface and a lower surface, the upper surface being exposed to the outside, the deck extending between the plurality of walls above the floor;

a space formed between the floor, the walls, and the lower surface of the deck;

at least one void extending through the deck from the upper surface of the deck, through the lower surface of the deck, and into the space, the at least one void configured to allow water to collect within the space, by passing through the at least one void, during play;

at least one deck structure extending upwardly from the upper surface of the deck, the at least one deck structure being enclosed and substantially hollow therein;

a power source;

at least one driving mechanism powered by the power source;

an output device operably coupled to the at least one driving mechanism; and a receiver operably coupled to the at least one driving mechanism and configured to receive signals remotely for controlling the at least one driving mechanism;

wherein, during play, the water collected in the space, as the result of an opponent shooting water, may at least partially submerge the toy ship, rendering it at least partially incapacitated; and wherein the at least one driving mechanism is a pump having an inlet and an outlet, the inlet extending through the hull and exposed outside the hull opposite the space, the outlet extending upwardly through the deck and operably coupled to the output device such that water is transferred from the inlet to the output device.

* * * * *